US005279710A

United States Patent [19]

Aikawa

[11] Patent Number: 5,279,710

[45] Date of Patent: Jan. 18, 1994

[54] DOCTOR BLADE SUPPORTING STRUCTURE

[75] Inventor: Yoshihiko Aikawa, Shizuoka, Japan

[73] Assignee: Aikawa Iron Works, Co., Ltd., Shizuoka, Japan

[21] Appl. No.: 793,446

[22] PCT Filed: May 15, 1990

[86] PCT No.: PCT/JP90/00611

§ 371 Date: Jan. 31, 1992

§ 102(e) Date: Jan. 31, 1992

[87] PCT Pub. No.: WO91/18147

PCT Pub. Date: Nov. 28, 1991

[30] Foreign Application Priority Data

Nov. 16, 1988 [JP] Japan ..... 63-148436

[51] Int. Cl.[5] ..... D21G 3/00

[52] U.S. Cl. ..... 162/281; 15/256.51

[58] Field of Search ..... 162/281; 15/256.51, 15/256.5, 256.53; 100/174

[56] References Cited

U.S. PATENT DOCUMENTS

| | | | |
|---|---|---|---|
| 2,477,339 | 2/1945 | Ljungquist | 162/281 |
| 3,085,275 | 4/1961 | Allison | 15/236 |
| 3,112,767 | 3/1964 | Carvillo | 15/256.51 |
| 3,649,991 | 3/1972 | Grimston et al. | 15/256.51 |
| 3,778,861 | 12/1973 | Goodnow | 162/281 |
| 4,789,432 | 12/1988 | Goodnow et al. | 162/281 |

FOREIGN PATENT DOCUMENTS

| | | | |
|---|---|---|---|
| 1635384 | 8/1966 | . | |
| 3623972 | 8/1987 | Fed. Rep. of Germany | 162/281 |
| 2019582 | 7/1970 | France . | |
| 368472 | 1/1931 | United Kingdom . | |
| 990670 | 12/1963 | United Kingdom . | |
| 1419616 | 11/1971 | United Kingdom . | |

*Primary Examiner*—Karen M. Hastings
*Attorney, Agent, or Firm*—Price, Gess & Ubell

[57] ABSTRACT

A doctor blade supporting structure for paper making rolls, which is provided with a reinforcing plate (5) laminated on a blade holder (2), and a finely adjusting screw (10) for use in regulating the blade holder (2) via the free edge ($5_1$), which is on the side of the blade (1), of the reinforcing plate (5) so that the blade holder (2) can be moved to engage and disengage from the blade (1). This structure enables a proper posture of the blade (1) to be retained, and the blade (1) in use to be engaged with the mating roll surface with a uniform and constant contact pressure distribution at all times. Moreover, the contact pressure of the blade (1) can be distributed uniformly in the axial direction of the roll surface.

5 Claims, 5 Drawing Sheets

DOCTOR BLADE SUPPORTING STRUCTURE

DESCRIPTION

Technical Field

This invention relates to a structure for supporting a doctor blade used for permitting a raw material to be satisfactorily accumulated on a paper making roll and water to be satisfactorily fed to the roll and removing foreign matters adhered to a surface of the roll such as paper powders, pitch, tailings or the like from the roll to keep it clean, and more particularly to a doctor blade supporting structure adapted to permit a pressure distributed at an edge of the blade pressedly contacted with the roll to be adjusted so as to be substantially uniform.

Background Art

A conventional doctor blade supporting structure which has been known in the art includes an adjusting means which acts to permit a blade for peeling off dusts adhered to a surface of a roll from the roll to be contacted at a tip end thereof with the roll surface at a uniform linear pressure or a contact pressure of the blade uniformly distributed in an axial direction of the roll.

In general, a blade for a doctor blade supporting structure is required to exhibit satisfactory holding force, stability and flexibility; therefore, the blade for the conventional doctor blade supporting structure is generally made of a relatively thin sheet material such as metal, plastic or the like into any desired thickness depending upon applications thereof. Unfortunately, this causes the blade to be pivotally moved with respect to the roll, resulting in the contact pressure of the blade being apt to be varied. In view of such a problem, a structure as shown in FIG. 7 is proposed and used, wherein a blade (G) is vertically interposed between a blade holder (F) made of a relatively rigid plate material and support members (C) and the blade holder (F) keeps the blade (G) at a posture. The support members (C) each are held directly on a doctor bag (E) using a screw means or pivotally supported on a pivot rod (D). Then, the blade (G) is vertically moved through a pressurized air tube (A) and an open tube (B) each interposedly arranged between the doctor bag (E) and the support member (C) to adjust a position of the blade (G).

The blade holder (F) comprises a single plate member formed into a shape of continuously extending in an axial direction of a roll, to thereby prevent a contact pressure of the blade (G) with respect to the roll from being varied in use. However, in order that the contact pressure of the blade (G) can be uniformly distributed in the axial direction of the roll, it is necessary to uniformly adjust contact between a surface of the roll and the blade (G). Unfortunately, this needs a considerable amount of labor. Further, a width of the blade holder (F) is finished by machining, however, a thickness of a blank for the blade holder (F) and its length are used as those of the holder (F) without being subject to finishing by machining, resulting in failing to form a contact end between the blade holder (F) and the blade (G) with high accuracy.

It would be considered that the accuracy of the contact end is increased by various processing techniques. However, this requires a considerable amount of labor and time and many processing machines, leading to a significant increase in manufacturing costs.

In view of the foregoing, the present situation is to escape an error occurring at the contact end utilizing crook of the blade holder (F); however, in order to accomplish the purpose, it is required to reduce a degree of crook of the blade holder (F) when the doctor blade supporting structure is directed to applications wherein the blade (G) is abutted against the roll at a high pressure, resulting in a relief being lost. This requires to further increase the accuracy of the contact end, so that it is highly difficult to press the blade against the roll at a constant linear pressure.

DISCLOSURE OF INVENTION

In accordance with the present invention, a doctor blade supporting structure is provided which comprises a blade (1) abutted against a roll (R), a blade holder (2) and support members (4), wherein the blade is mounted on the support members through the blade holder by means of mounting screws (3). The structure is characterized in that a reinforcing plate (5) is arranged in a manner to be superposed on the blade holder (2); and finely adjusting screws (10) are arranged so as to permit a gap to be defined between the blade holder (2) and the reinforcing plate (5) or support members (4) so that the blade holder (2) may be approachable or accessible to the blade (1) through a free end ($5_1$) of the reinforcing plate (5) defined on the side of the blade. Such construction of the present invention permits the structure to effectively absorb strain of each of the roll (R) and blade (1) occurring during operation of the structure while contacting the blade (1) with the roll (R), so that a linear pressure of the blade with respect to the roll (R) may be automatically corrected so as to be uniform over a whole width of the blade.

In particular, the structure of the present invention is so constructed that the blade holder (2) is pressedly fixed by the reinforcing plate (5) on which the blade holder (2) is mounted by means of the mounting screws (3) and the finely adjusting screws (10) are arranged so as to permit the gap to be defined between the blade holder (2) and the reinforcing plate (5) or support members (4) so as to render the blade holder (2) approachable or accessible to the blade (1) through the free end ($5_1$) of the reinforcing plate (5) positioned on the side of the blade. Thus, tightening of each of the finely adjusting screws (10) causes a tip end of the blade (1) to be lowered and pressedly abutted against the roll, whereas loosening of the screw causes pressing force of the blade (1) against the roll to be reduced; thus, adjustment of the pressing force is highly facilitated to satisfactorily increase holding force and stability of the blade, to thereby permit the blade to be uniformly pressed against the roll at a constant linear pressure. Also, the above-described construction permits the crook of the blade holder in a direction of a thickness thereof to be reinforced, so that the blade holder (2) itself may be formed into a reduced thickness as compared with the prior art. This results in distortion and bending of the blade in a longitudinal direction thereof permitting the blade to exhibit improved response performance or characteristics.

Accordingly, the present invention keeps the blade (1) at a satisfactory posture while eliminating a necessity of subjecting the reinforcing plate (5) to fine processing and permits the blade holder (2) to prevent the contact pressure of the blade (1) from being varied because the blade (1) is uniformly abutted against a surface of the roll. Also, the present invention permits the contact pressure of the blade with respect to the surface of the roll to be uniformly distributed in an axial direction of the roll and also permits the reinforcing plate (5) to be formed into a reduced thickness.

BRIEF DESCRIPTION OF DRAWINGS

In the accompanying drawings,

FIG. 1A is a fragmentary vertical sectional view of the structure of FIG. 1 in use;

FIG. 3A is a fragmentary vertical sectional view of the structure of FIG. 3 in use;

BEST MODES FOR CARRYING OUT INVENTION

Figure 1:
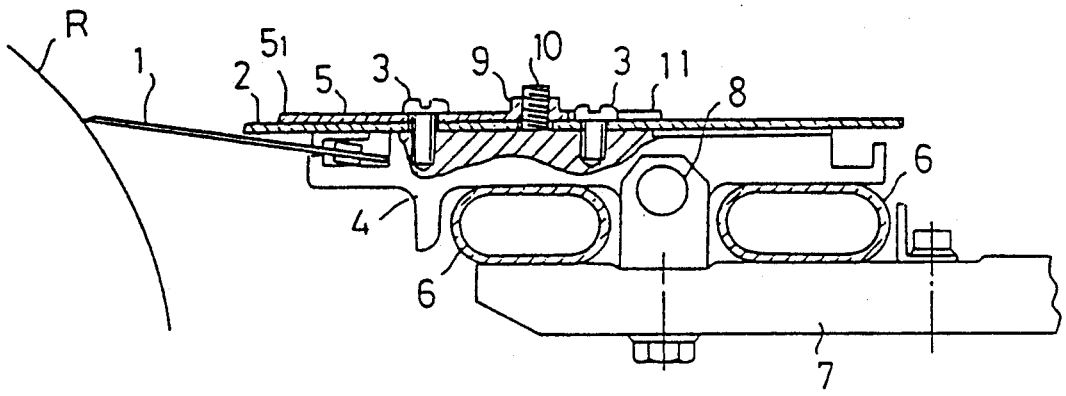
FIG. 1 is a fragmentary vertical sectional view showing an embodiment of a doctor blade supporting structure according to the present invention.
Figure 1:
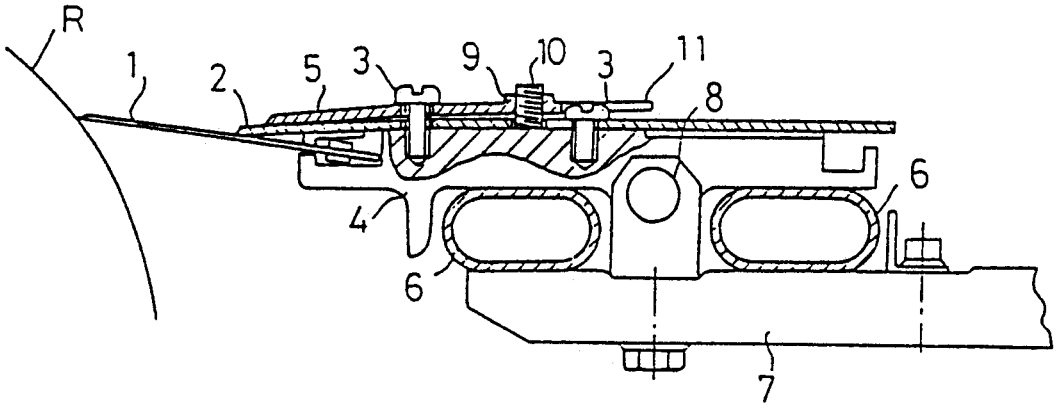
Figure 2:
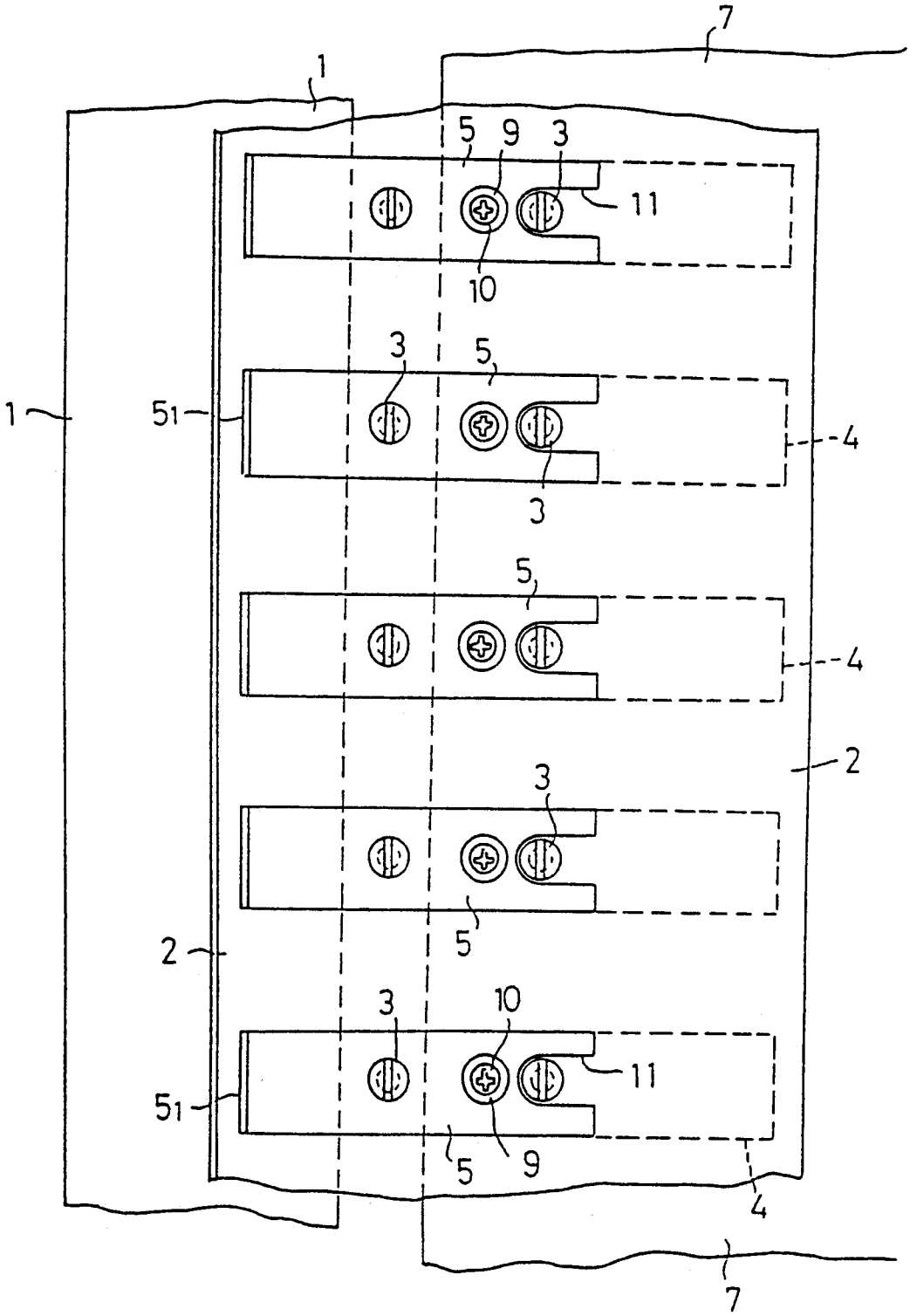
FIG. 2 is a plan view of the doctor blade supporting structure shown in FIG. 1.

FIGS. 1 to 2 illustrate an embodiment of a doctor blade supporting structure according to the present invention. A doctor blade supporting structure of the illustrated embodiment includes a blade 1 adapted to be abutted against a roll R, which blade is mounted on support members 4 by means of a first set of mounting screws 3 provided for assembling a blade holder 2 of resilient material. The doctor blade supporting structure also includes a reinforcing plate 5 of resilient material arranged in a manner to be laminated or superposed on the blade holder 2. A second set of mounting screws 3' mounts the reinforcing plate 5 to the blade holder 2. Further, the structure includes finely adjusting screws 10 each of which acts to permit a gap to be defined between the blade holder 2 and the reinforcing plate 5 or each of the support members 4 so that the reinforcing plate pivots at said second set of mounting screws thereby pressing free ends $5_1$ against blade holder 2 which causes the blade holder 2 to move to engage with the blade, and thus the blade holder 2 may be moved through a free end $5_1$ of the reinforcing plate 5 defined on the side of the blade 1 so as to be approachable or accessible to the blade 1. The blade 1 is firmly held on the support members 4.

The reinforcing plate 5, as shown in FIG. 2, comprises a plurality of rectangular plate elements arranged on the blade holder 2 in a manner to be spaced at intervals. It is preferable that the plate elements of the reinforcing plate 5 are separately fixedly held on the support members 4 by means of the mounting screws 3', respectively. Such arrangement effectively prevents distortion and bending actions of the blade 1 in a longitudinal direction thereof from being deteriorated, to thereby substantially improve responsibility of the blade in the longitudinal direction. In particular, when the blade 1 is pivotally arranged through a support shaft 8 and held on the support members 4 each mounted through air tubes 6 on a doctor bag 7, it is preferable that the plate elements of the reinforcing plate 5 formed into the same width as the support members 4 are fixed together with the blade holder 2 by means of the mounting screws 3'.

The finely adjusting screws 10 are threadedly arranged in threaded holes 9 formed through the reinforcing plate 5 in a manner to be movable in an axial direction thereof in the holes 9 and then inserted into through-holes formed via the blade holder 2 so as to be abutted against the support members 4, so that threaded insertion of the finely adjusting screws 10 through the reinforcing plate 5 permits the other end of each of the plate elements of the reinforcing plate 5 to be approachable or accessible to the blade holder 2 to form a gap therebetween.

Figure 3:
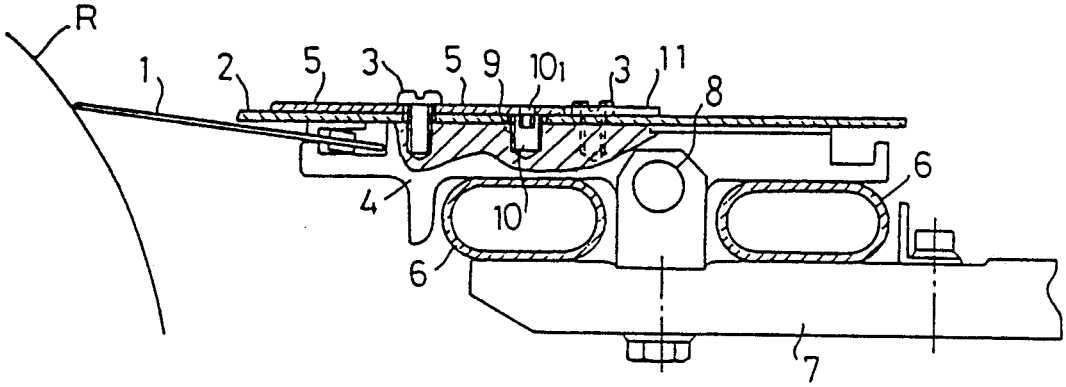
FIG. 3 is a fragmentary vertical sectional view showing another embodiment of a doctor blade supporting structure according to the present invention.
Figure 3:
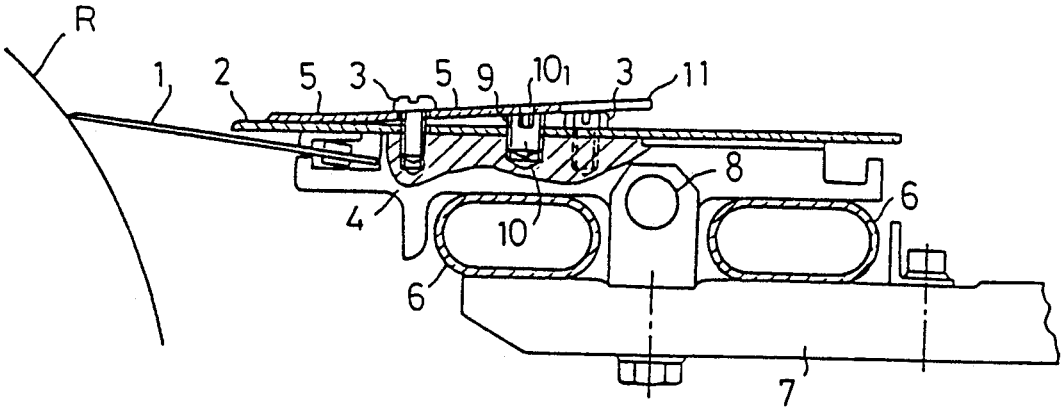

In another embodiment of the present invention shown in FIG. 3, finely adjusting screws 10 inserted in through-holes formed via a blade holder 2 each are tapped with respect to a support member 4 and abutted at a head portion thereof against a lower surface of a reinforcing plate 5. Also, the reinforcing plate 5 is formed with holes $10_1$ each of which permits a hexagon wrench to operatively engage therethrough with the head portion of the finely adjusting screw 10 to vertically move it, to thereby cause the other end of the reinforcing plate 5 to be vertically moved to define a gap between the reinforcing plate 5 and the blade holder 2, so that a posture of contact of a blade 1 with respect to a roll R may be adjusted.

At least one of the mounting screws 3 may be kept somewhat loosened when the adjustment is carried out, to thereby facilitate operation for the adjustment. Alternatively, in each of the embodiments described above, the plate elements of the reinforcing plate 5 each may be formed with a notch 11 for receiving the mounting screw therein as shown in FIGS. 1 and 3.

Figure 4:
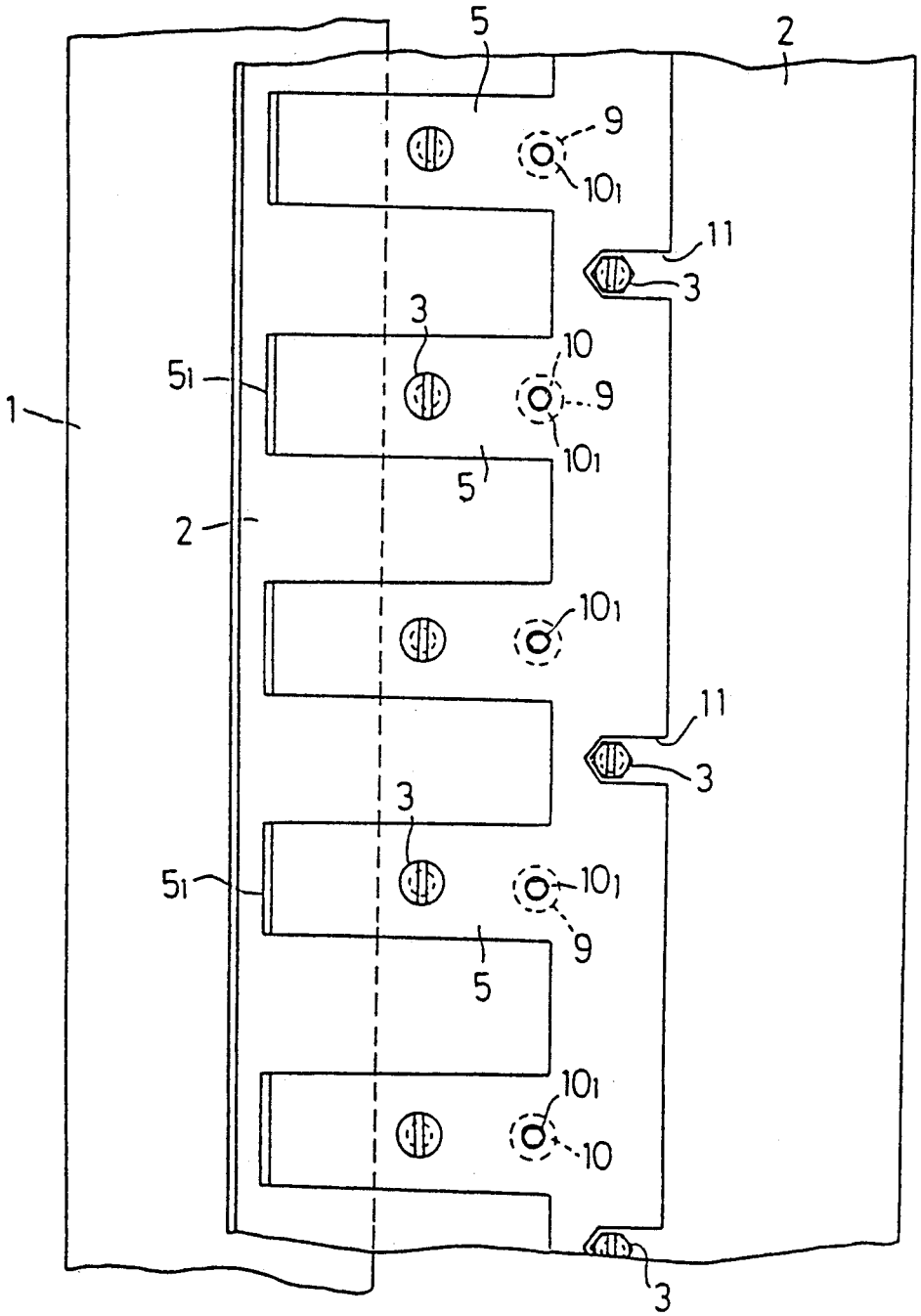
FIG. 4 is a plan view of the doctor blade supporting structure shown in FIG. 3.

In the embodiment of the present invention shown in FIG. 3, the reinforcing plate 5, as shown in FIG. 4, comprises a single plate member of a pectinate or rugged shape so that a free end $5_1$ of the reinforcing plate may be provided with a plurality of projections. Such construction of the reinforcing plate 5 facilitates assembling, mounting and handling of the reinforcing plate 5.

Figure 5:
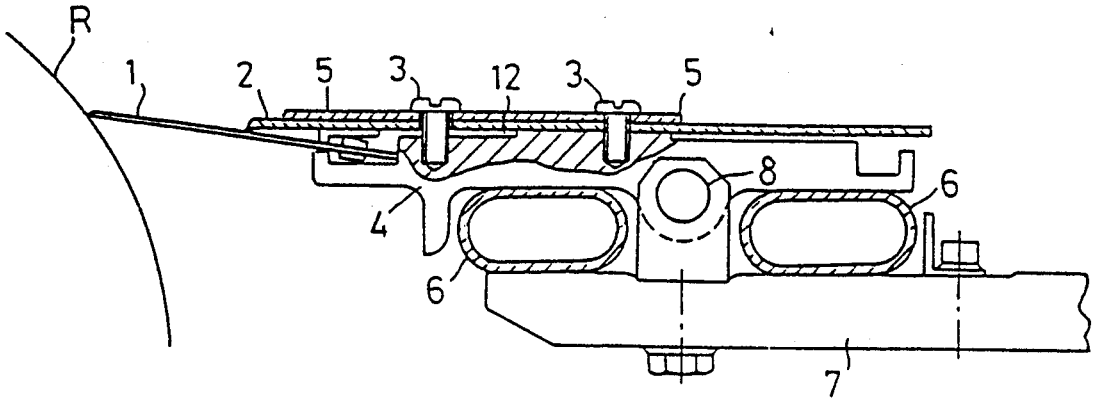
FIG. 5 is a fragmentary vertical sectional view showing a further embodiment of a doctor blade supporting structure according to the present invention.

In a still further embodiment of the present invention shown in FIG. 5, between a support member 4 and a portion of a blade holder 2 overlapped with a reinforcing plate 5 and positioned around a mounting screw 3' arranged on the side of a blade 1 is formed a gap 12, so that threaded insertion of the mounting screw 3' into the support member 4 permits the reinforcing plate 5 and blade holder 2 to be moved together, to thereby vertically adjustably move an end of a blade 1 which is contacted with a roll R. Thus, it will be noted that the mounting screws 3' each function also as a finely adjusting screw.

Figure 6:
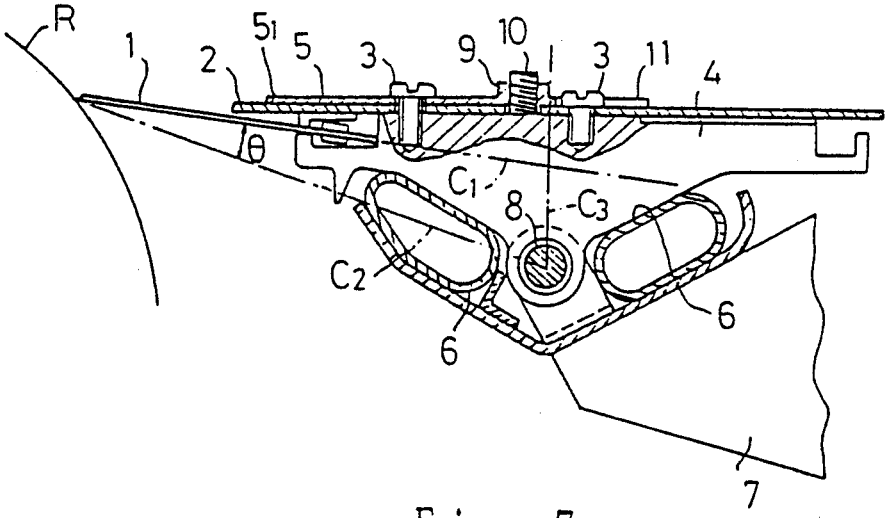
FIG. 6 is a fragmentary vertical sectional view showing still another embodiment of a doctor blade supporting structure according to the present invention.
Figure 7:
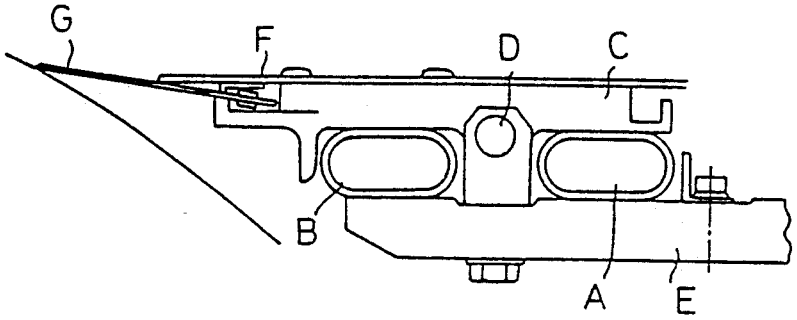
Fig. 7 PRIOR ART
FIG. 7 is a fragmentary vertical sectional view showing a conventional doctor blade supporting structure.

In still another embodiment of the present invention shown in FIG. 6, air tubes 6 and 6 are arranged below an extension line $C_1$ defined by extending a line defined between an edge of a blade 1 and a portion of the blade 1 held on support members 4. Also, the air tubes 6 are arranged opposite to each other in a V-like or Y-like manner about an intersection between a line $C_2$ extending from the edge of the blade 1 at an angle $\theta$ of 6 to 30 degrees and preferably 10 to 15 degrees below the extension line $C_1$ and a vertical line $C_3$. Such construction permits a contact angle of the blade with respect to a roll R to be increased, to thereby decrease a variation of the contact angle due to wearing of the blade 1, resulting in facilitating adjustment of a contact pressure of the blade with respect to the roll R and removal of any tailings from the roll R. Also, such construction permits the blade 1 to be uniformly pressed against the roll R.

INDUSTRIAL APPLICABILITY

The present invention is so constructed that the reinforcing plate is arranged in a manner to be superposed on the blade holder and the finely adjusting screws each are arranged so as to permit a gap to be defined between the blade holder and the reinforcing plate or support member, resulting in the blade holder being approachable or accessible to the blade through the free end of the reinforcing plate defined on the side of the blade. Such construction provides a relief for fine adjustment without requiring to form the contact end of the blade holder with high accuracy. Also, it permits crook of the blade holder to be reduced during pressing of the blade against the roll, to thereby keep the blade at a natural posture. Further, it permits the blade to be significantly reinforced against the crook of the blade holder while exhibiting a function of pressing the roll at a predetermined line pressure, so that the blade holder may be formed into a reduced thickness as compared with the prior art. This results in distortion and bending of the blade in a longitudinal direction thereof allowing the blade to exhibit a more satisfactory function. In addition, crook of the blade holder in a radial direction of the roll can be reduced to substantially improve response performance or characteristics of the blade in the longitudinal direction and a doctor line pressure can be rendered uniform over a whole width of the roll, so that the doctor blade supporting structure of the present invention is widely and readily applicable to existing apparatus while ensuring positive operation of the blade at a low cost and permitting the blade to positively exhibit satisfactory holding force, stability and flexibility. Thus, the present invention can be highly effectively available as a doctor blade supporting structure for a paper making roll.

What is claimed is:

1. A doctor blade supporting structure including a blade abutted against a roll, a blade holder of resilient material, the blade holder having a first surface that faces the blade and a second surface that faces away from the blade, and support members, said blade being mounted on said support members through said blade holder by means of a first set of mounting screws threaded into said support members, the improvement comprising:

a reinforcing plate mounted on the blade holder by means of a second set of mounting screws spaced from and located closer to the roll than said first set of mounting screws, said reinforcing plate being substantially in contact with the second surface of said blade holder, said reinforcing plate including a plurality of free end portions which are spaced at intervals along a longitudinal direction of said blade and each of which has a free end in contact with the second surface of said blade holder; and finely adjusting screws structured and arranged so as to permit a gap to be defined between said blade holder and said reinforcing plate or support members so that said reinforcing plate pivots at said second set of mounting screws thereby pressing free ends against said blade holder which causes said blade holder to move to engage with said blade.

2. A doctor blade supporting structure as defined in claim 1, in which:

said reinforcing plate has a blade portion being that part of the plate between the free ends and the second set of mounting screws and an opposite portion being that part of the plate between the second set of mounting screws and notches formed in an opposite end of said reinforcing plate from said free ends; and said finely adjusting screws are threadedly arranged on the opposite portion of said reinforcing plate.

3. A doctor blade supporting structure as defined in claim 1, in which:

said reinforcing plate has a blade portion being that part of the plate between the free ends and the second set of mounting screws and an opposite portion being that part of the plate between the second set of mounting screws and notches formed in an opposite end of said reinforcing plate from said free ends;

said reinforcing plate comprises a plate member formed with holes, in the opposite portion of the plate, for operating said finely adjusting screws; and said finely adjusting screws each are threadedly inserted into said support member and abutted at a head portion thereof against a surface of said reinforcing plate that faces said blade holder.

4. A doctor blade supporting structure as defined in claim 1, further comprising:

means to pivotally mount said support members on a doctor bag; and means to arrange air tubes between said support members and said doctor bag such that said air tubes are arranged below an extension line defined by extending a line defined between an edge of said blade abutted against the roll and a portion of said blade held on said support members and in a manner to be slanted towards each other at an intersection between a line extending from the edge of said blade at an angle of 6 to 30 degrees below the extension line and a vertical line forming a V-shaped configuration when viewed in cross section.

5. A doctor blade supporting structure as defined in claim 1, further comprising:

means to pivotally mount said support members on a doctor bag; and means to arrange air tubes between said support members and said doctor bag.

* * * * *